United States Patent [19]

Grasshoff

[11] 4,420,960

[45] Dec. 20, 1983

[54] ARRANGEMENT FOR HOT-ROLLING OF METAL WORKPIECES

[75] Inventor: Hans W. Grasshoff, Dortmund, Fed. Rep. of Germany

[73] Assignee: Estel Hoesch Werke Aktiengesellschaft, Dortmund, Fed. Rep. of Germany

[21] Appl. No.: 260,188

[22] Filed: May 5, 1981

[30] Foreign Application Priority Data

May 20, 1980 [DE] Fed. Rep. of Germany ..... 3019123

[51] Int. Cl.[3] ..... B21B 1/26; B21B 41/02; B21B 41/06; B21B 45/00

[52] U.S. Cl. ..... 72/202; 72/231; 72/234; 72/229

[58] Field of Search ..... 72/128, 200, 202, 342, 72/364, 365, 227, 229, 231, 234

[56] References Cited

U.S. PATENT DOCUMENTS

| | | | |
|---|---|---|---|
| 373,463 | 11/1887 | Lenox | 72/202 |
| 1,771,688 | 7/1930 | Nye | 72/202 |
| 1,957,009 | 5/1934 | Broemel | 72/202 |
| 2,658,741 | 11/1953 | Schmidt et al. | 72/200 X |
| 3,486,359 | 12/1969 | Hein | 72/200 |
| 4,083,218 | 4/1978 | Berz | 72/201 |
| 4,263,798 | 4/1981 | Wladika et al. | 72/202 |

FOREIGN PATENT DOCUMENTS

| | | | |
|---|---|---|---|
| 460866 | 2/1937 | United Kingdom | 72/202 |

*Primary Examiner*—Ervin M. Combs
*Attorney, Agent, or Firm*—Max Fogiel

[57] ABSTRACT

A hot-rolling mill has a rough-rolling section and a finish-rolling section. These sections are transversely offset from one another and the end of the rough-rolling section is connected to the beginning of the finish-rolling section by a heating station. Within the heating station, at the end of the rough-rolling station, is mounted a take-up coiler for the rough product. This coiler can transfer its product coil to a pay-out coiler which is either movable transversely between the two sections so that it can move to the second path and feed the product into the second or is fixedly mounted at the beginning of the second (finish-rolling) section in which case a transporting device is provided which transports the coils from the take-up coiler to the pay-out coiler.

1 Claim, 4 Drawing Figures

ARRANGEMENT FOR HOT-ROLLING OF METAL WORKPIECES

BACKGROUND OF THE INVENTION

The present invention relates to the hot-rolling of metal workpieces, and more particularly to an arrangement for effecting such hot-rolling.

Metal workpieces, such as metal slabs, are conventionally passed over a roughing section of the rolling mill where they are rolled to a product having roughly the desired dimensions, and then passed over a finishing section of the rolling mill where the rough product is rolled to the final (finished) desired dimensions. At the end of the roughing section the rough product is taken up by coilers and is then fed to the finishing section.

In these known arrangements the roughing section and the finishing section are arranged in a common line and the coilers and uncoilers are located between the end of the roughing section and the start of the finishing section. It is desirable to be able to increase the weight and size of the coils of rough product, but this has not heretofore been possible because the in-line arrangement and the location of the coilers and uncoilers between the sections, have imposed space limitations which have frustrated all attempts at increasing coil size.

SUMMARY OF THE INVENTION

It is, therefore, an object of the invention to overcome the prior-art disadvantages.

A more particular object of the invention is to provide an improved arrangement for hot-rolling of metal workpieces, which is not possessed of these disadvantages.

Still more specifically, it is an object of the invention to provide an arrangement of the type under discussion which is suitable for use in new construction of rolling mills and there permits a substantially increased coil weight to be used even where space is limited, and which can also be used for retro-fitting existing rolling mills so as to allow them to be operated with increased coil weights.

In keeping with these and still other objects which will become apparent hereafter, one feature of the invention resides in an arrangement for hot-rolling metal workpieces which, briefly stated, may comprise first means including at least one roughing stand in which the workpiece is rough-rolled to a product having roughly the desired dimensions while advancing along a first path. Second means are also provided, including at least one finishing stand in which the rough-rolled product is finish-rolled to the final desired dimensions while advancing along a second path which is offset from the first path.

A heating station extends between the end of the first path and the beginning of the second path.

A take-up coiler is provided in the heating station at a location adjacent the end of the first path and coils up the rough product which is kept warm in the heating station. Transporting means transport the coiled-up product from the aforementioned location to the beginning of the second path, so that the rough product may then be fed to the second means for finish rolling.

The first and second means (and hence the first and second paths) may be so offset relative to one another as to include with the heating station a Z-shaped configuration.

According to another, and particularly compact arrangement, the two paths and the heating station may together define a U-shaped configuration.

The roughing stand of the first means may be reversing stand. If so, it is advantageous if the string of run-out rollers which follows the stand, extends not only to the heating station but extends underneath the coiler and transporting means in the heating station and actually extends beyond the heating station.

The invention will hereafter be described with reference to several exemplary embodiments as illustrated in the appended drawings. However, this is for purposes of explanation only and is not to be considered limiting to the illustrated embodiments.

DESCRIPTION OF PREFERRED EMBODIMENTS

Figure 1:
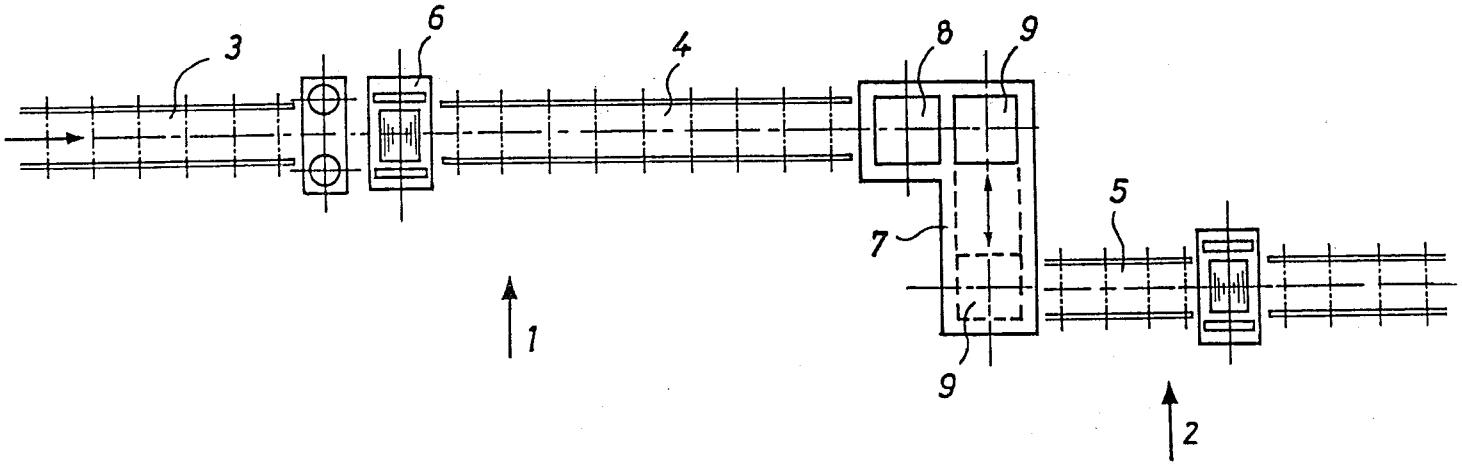
FIG. 1 is a diagrammatic top-plan view of one embodiment according to the invention.

In all embodiments like reference numerals identify like elements.

With this in mind it will be seen in FIG. 1 that the Figure is a diagrammatic illustration of a rolling mill for hot metal workpieces which are converted to strip, sheet or analogous form. The mill has a roughing section 1 and a subsequently arranged finishing section 2 which is offset relative to the section 1. Section 1 has run-in rollers 3 and run-out rollers 4, and section 2 has run-in rollers 5. In this Figure, as well as in the other ones, the section 1 has, as usual, one or more (one shown) roughing stand for converting the metal workpiece (e.g. slab) to a roughly dimensioned product. The roughing stand is here shown to be a reversing stand 6, but could be in form of a different roller stand.

Arranged between the end of the section 1 and the beginning of the section 2 is a heating or warming station 7, where the rough-rolled product is kept at the proper temperature for finish rolling. Such stations are, of course, known per se. Within the station 6 there is provided a take-up station 8 (or coiler) and a pay-out station 9 (or uncoiler) for the rough-rolled product from section 1.

In FIG. 1 the station 9 can be moved transversely of the elongation of the sections 1 and 2 within the station 6. In other words, when it receives coiled rough product from the station 8, the station 9 can then move transversely to the beginning the section 9 and feed this rough product into the section 2 for finish rolling therein.

Figure 2:
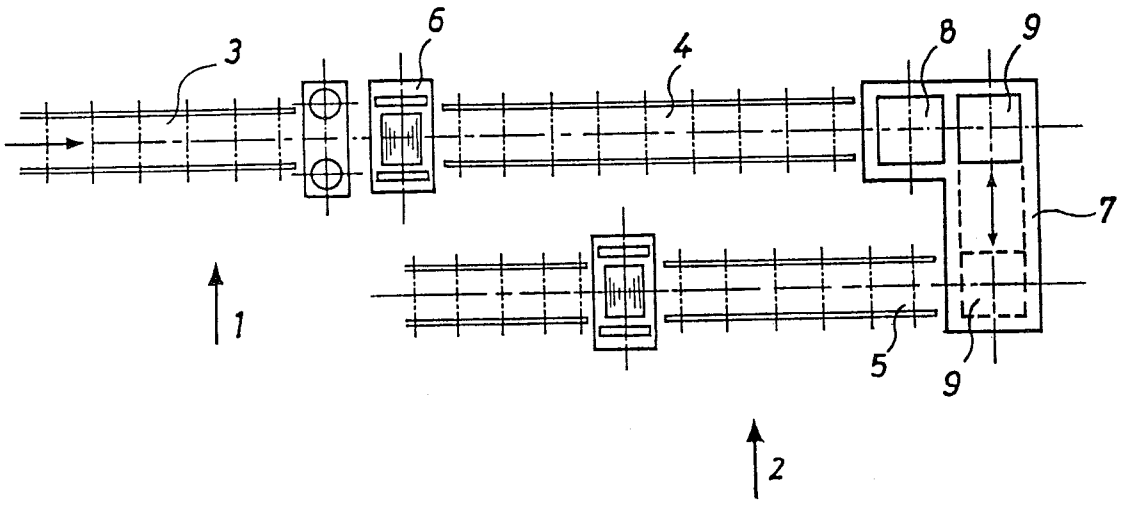
FIG. 2 is a view similar to FIG. 1 but of a different embodiment.

FIG. 2 has the same arrangement as FIG. 1, except that where the sections 1, 2 and the station 6 in FIG. 1 define with one another a Z-shaped configuration, the embodiment of FIG. 2 is such that these same sections define with one another a U-shaped configuration. This is a particularly space-saving solution.

Figure 3:
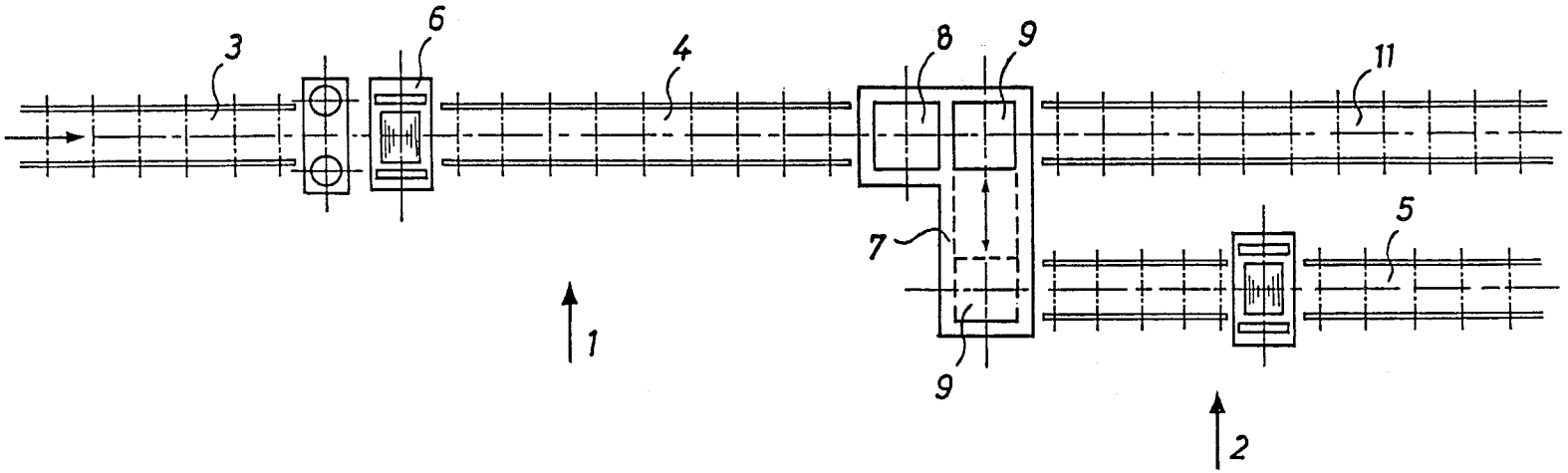
FIG. 3 is a view similar to FIG. 1 but showing a further embodiment.

The embodiment in FIG. 3 corresponds to the one in FIG. 1, except that the run-out rollers 4 are extended by a section of run-out rollers 11 which extends to and(underneath) beyond the heating station 6, so as to be in part located beneath the stations 8 and 9 (when the latter is located next to station 8). An advantage of this is that the rollable strip-length which can be handled, can be increased by the presence of the rollers 11.

Figure 4:
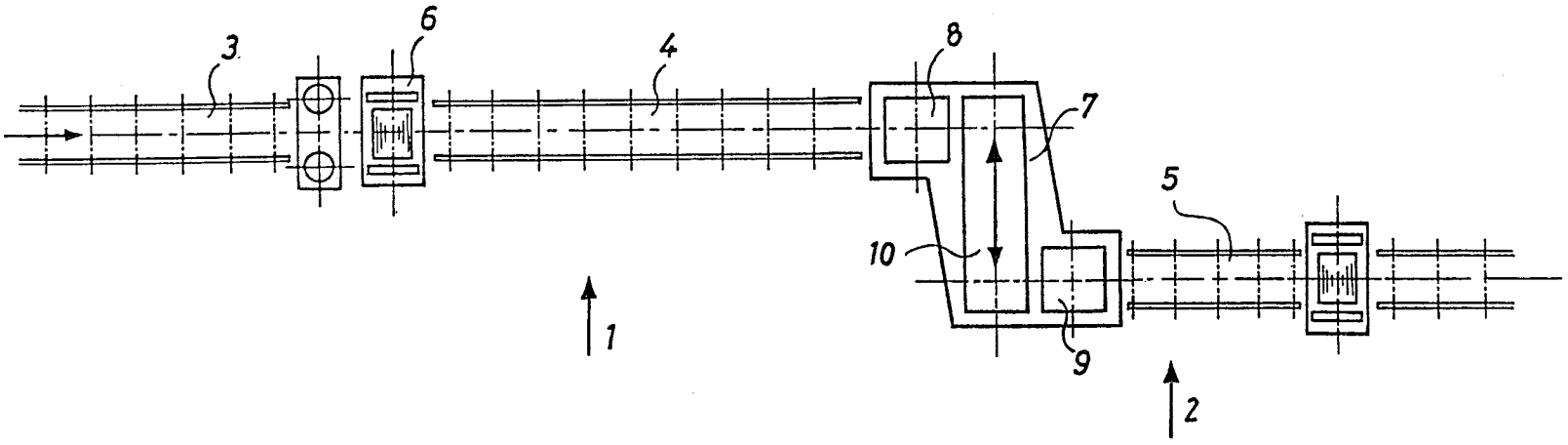
FIG. 4 is another view similar to FIG. 1 but of still a further embodiment of the invention.

In the embodiment of FIG. 4 the station 9 is fixed, i.e. not transversely movable. Instead, there is provided within the station 6 a transporting device 10 (known per se) which transports coils from the station 9 to the section 2. In fact, the device 10 can in effect as a buffer storage between the sections 1 and 2, in that due to its presence it is possible for coils to be located simultaneously in the station 8, the station 9 and the device 10 (which serves then also as a holding arrangement).

The band (rough product) leaving the section 1 is coiled up in station 8, handed over directly (FIGS. 1–3) to the station 9 or indirectly (FIG. 4) via the transporting device 10, and is then fed from the station 9 into the section 2 for finish rolling. If the coiled band is directly handed over to the station 9, then the station 9 is moved transversely in the station 6 until it becomes located at the beginning of the section 2 (FIGS. 1–3). After the band has left the station 9, the latter returns to its previous position in line with the end of the section 1 and again takes over the band which has meanwhile been newly coiled up by the station 8.

In the case of FIG. 4, the band coiled up at station 8 is transported transversely in the station 6 by the device 10 and handed over to the station 9 which is fixedly installed at the beginning of the section 2.

In either case, once the station 8 has handed over its coil of band to the station 9 or to the device 10, it is immediately ready to start taking up new band coming from the section 1.

An overall advantage of the invention is that it permits a ready increase in the coil weight, even where the available space is quite limited. A particular advantage of the embodiment in FIG. 2 is that the supplying of the slabs and the removal of the finish-rolled material can be concentrated at one location, and that the pressurized-water supply equipment and other items of equipment can be located centrally and with only slight spacing from the rolling stands and other mill equipment. As far as FIG. 3 is concerned, one of its particular advantages is that the band rolled by the stand 6 of section 1 can pass beneath the station 7 during the various passes which it undergoes, since it can move on the rollers 11, and that it need be taken up on the station 8 only when its final rough-pass is completed.

The invention, as illustrated with reference to the various illustrated embodiments, is susceptible of a variety of modifications which are intended to be encompassed within the protection of the appended claims.

What is claimed is:

1. Arrangement for continuous hot-rolling of metal workpieces, comprising:

first means, including at least one roughing stand in which the workpiece is rough-rolled to a product having roughly the desired dimensions while advancing along a first path;

second means, including at least one finishing stand in which the rough-rolled product is finish-rolled to the final desired dimensions while advancing along a second path which is offset from said first path;

a heat-retaining station extending between an end of said first path and a beginning of said second path;

a take-up coiler in said heat-retaining station at a location adjacent said end of said first path for coiling up the rough-rolled product; and transporting means in said heat-retaining station for transporting the coiled-up rough product from said location to said beginning of said second path; said transporting means and take-up coiler separating said first means from said second means inside a continuous rolling train, said product being retained hot in passage through said take-up coiler and transporting means, winding of the coil producing a heating effect for retaining said coil in heated condition due to reduction in exposed surface from which heat flow may take place, said heat-retaining station comprising a coiling and uncoiling station, said heating station being free from externally supplied heat; said first and second paths being laterally offset from one another, said transporting means comprising an uncoiler for paying out coiled rough product, said uncoiler being movable between said location and said beginning of said second paths, said first and second paths being so offset relative to one another as to form with said heat retaining station a Z-shaped outline, said roughing stand of said first means being a reversing stand and said first means further including a string of run-out rollers extending from said reversing stand to said heat-retaining station and extending underneath the take-up coiler and the transporting means and beyond said heat-retaining station in line with said first path.

* * * * *